US006488519B1

(12) United States Patent
Kan

(10) Patent No.: US 6,488,519 B1
(45) Date of Patent: Dec. 3, 2002

(54) ELECTRIC WIRE CONNECTION SEAT WITH A CONTACT SWITCH

(76) Inventor: Chin-Mao Kan, No. 20, Ln.211, Pu Chung Rd., ChungLi, TaoYuan (TW)

( * ) Notice: Subject to any disclaimer, the term of this patent is extended or adjusted under 35 U.S.C. 154(b) by 0 days.

(21) Appl. No.: 09/784,156

(22) Filed: Feb. 16, 2001

(51) Int. Cl.[7] ..... H01R 29/00
(52) U.S. Cl. ..... 439/188; 439/489
(58) Field of Search ..... 439/188, 676, 439/489, 189

(56) References Cited

U.S. PATENT DOCUMENTS 5,312,273 A * 5/1994 Andre et al. ..... 439/188
6,073,853 A * 6/2000 Odic ..... 439/188
6,159,051 A * 12/2000 Chang ..... 439/188
6,231,362 B1 * 5/2001 Wu ..... 439/188

* cited by examiner

*Primary Examiner*—Gary Paumen
(74) *Attorney, Agent, or Firm*—Troxell Law Office PLLC

(57) ABSTRACT

An electric wire connection seat includes a contact switch, which is comprised of a connection seat major body, a contact switch, and a plurality of fixing guide-needles. An inserting groove is arranged on the back face of the connection seat major body. A connection hole is arranged on the lower portion of the connection seat in which is placed the contact switch. Thus, when the electric wire connection head is inserting into the inserting groove, contact arms of the contact switch will be pressed down by the electric wire connection head to separate from the contact-press-connection points and change the path state of the electric circuit.

3 Claims, 4 Drawing Sheets

ELECTRIC WIRE CONNECTION SEAT WITH A CONTACT SWITCH

FIELD OF THE INVENTION

The present invention relates to an improvement of an electric wire connection seat, especially to an electric wire connection seat with a contact switch arranged inside, with which an on or a break states of electric circuit are controlled to show the connection states of the electric wire without connecting another set of electric circuit to achieve this function and to improve and promote the product quality of the electric wire connection seat effectively.

BACKGROUND OF THE INVENTION

Accordingly, with the continuous progress and the quick development of the digital technology, regardless of the professional manufacturing factories or daily living necessities all have developed toward the direction of application of digital technology to promote their product functions. On the other hand, the manufacturers are also continuously studying and producing out lighter, thinner, shorter, and smaller products, so the electric wire connection seat, commonly and currently used in any kind of electric appliance and electric circuit board, must be improved accordingly to develop its maximum function. The prior electric wire connection seat is mainly comprised of a connection seat major body, and several fixing guide-needles. Therefore, prior art only has a connection function. As it can be seen, with the continuous progress, the quick development and the increasing requirements of the digital century, more functions whose objects are to create more conveniences, for instance, a user is easily aware that the connection does work or not when the connection seat is connected to the electric circuit. Hence, how to add more functions to suit the life of human being is the topic discussed in the present invention.

In the fore-mentioned structure of the connection seat, although it provides the connection function, it cannot reach the object of displaying the states of the connection of the electric circuit, and it also must connect another electric wire to a LED panel to display the states of the electric circuit. This is the shortcoming that obviously can not be overcome by the prior design.

BRIEF DESCRIPTION OF THE INVENTION

The main object of the present invention is to provide an electric wire connection seat with a contact switch, which is comprised of a connection seat major body, a contact switch, and several fixing guide-needles. The major design concept: by an additional installation of a contact switch, when the electric wire connection head is inserted into the groove of the connection seat, the guide-needles of the contact switch will be pressed down by the electric wire connection head to separate the contact-press-connection points and chance the path state of the electric circuit. We can apply this phenomenon to control on or off of the electric circuit and display the different states of the electric circuit without connecting another circuit wire to the LED panel to display the states of the electric circuit. This design can match with the application of other logic electric circuit to promote the merits of product quality by the output of this kind of signal change.

An inserting groove is arranged on the back face of the connection seat major body and several grooves are arranged on the upper portion of the inserting groove. The guide-needles are then fastened up inside the grooves. To reach the object of an on state of an electric circuit by the connection of the electric wire connection head, a convex block is installed on the connection seat major body for providing the inserting-in and fastening-up functions of the electric wire connection head. A connection handle, arranged on the corresponding position of the electric wire connection head can be inserted into the inserting groove and fastened up fixedly with the convex block during connection.

For the characteristics and the functions of the present invention, a detailed description with corresponding diagrams are presented.

DETAILED DESCRIPTION OF THE PREFERRED EMBODIMENTS

Figure 1:
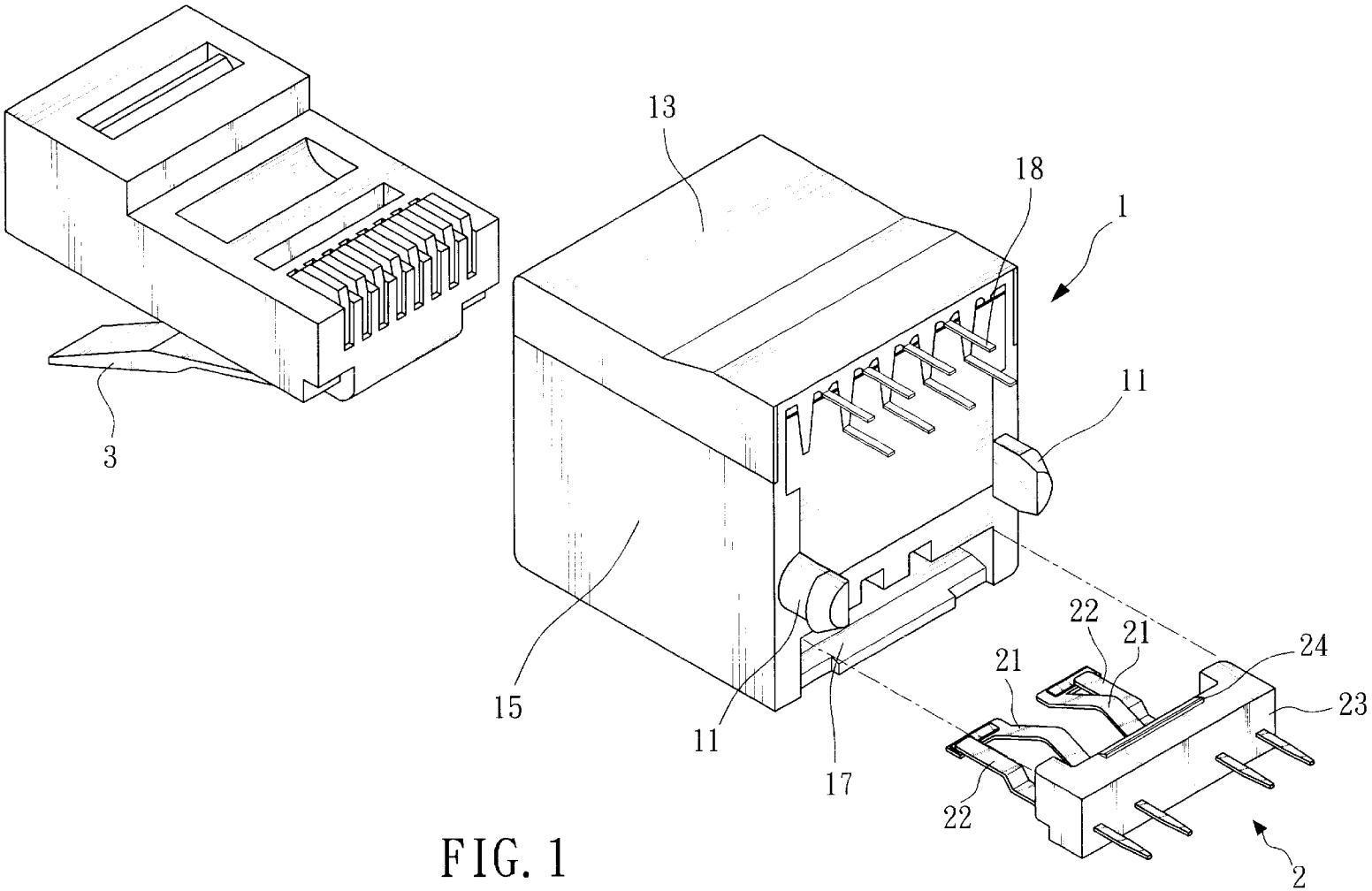
FIG. 1 is a three-dimensional illustration for the present invention.
Figure 2:
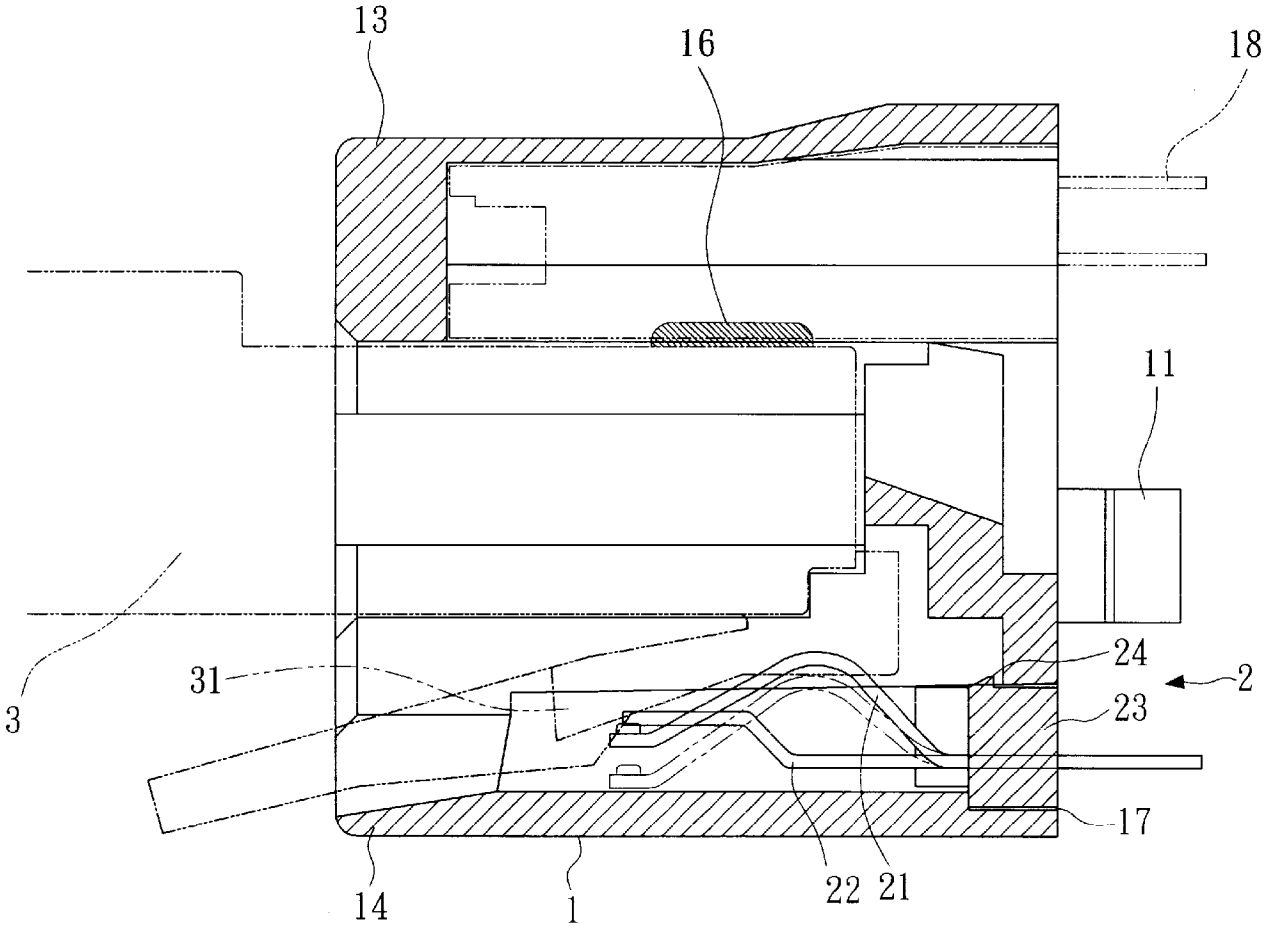
FIG. 2 is a cross-sectional view of the present invention.
Figure 3C:
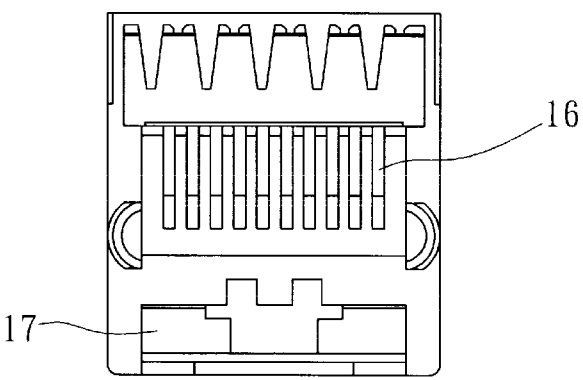
FIG. 3C is a front view of the electric wire connection seat of the present invention.
Figure 3A:
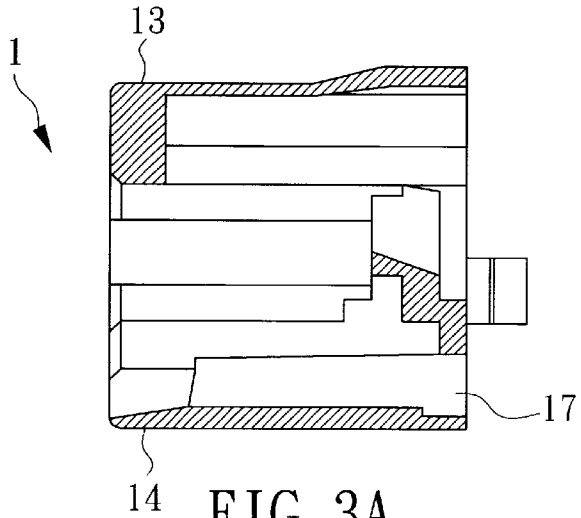
FIG. 3A is a cross-sectional view of the wire connection seat of the present invention.
Figure 3B:
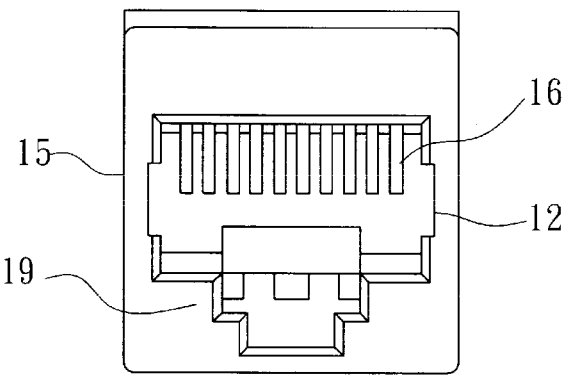
FIG. 3B is a rear view of the wire connection seat of the present invention.
Figure 4A:
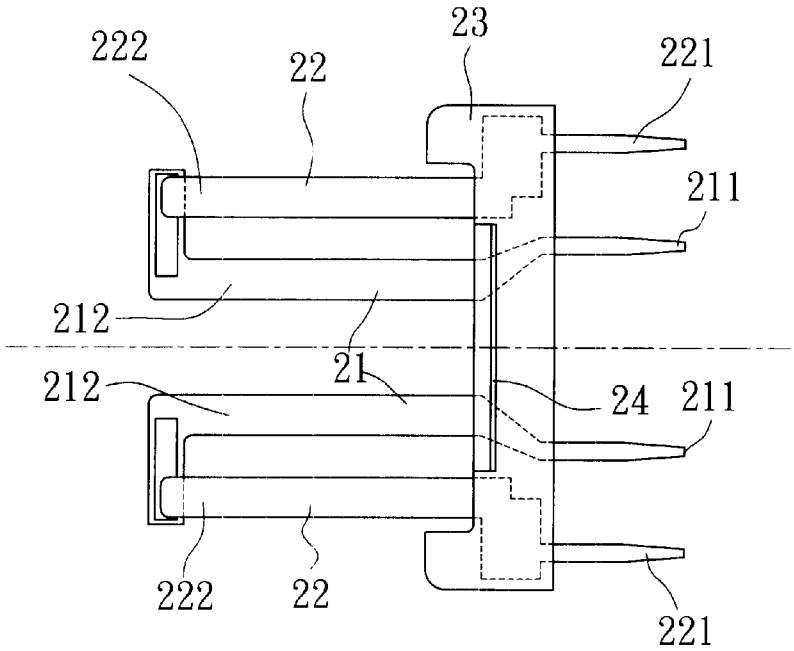
FIG. 4A is a top view of the contact switch of the present invention.
Figure 4B:
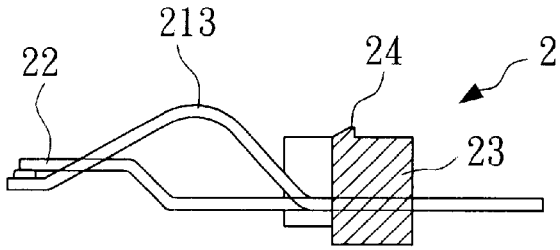
FIG. 4B is a side view of the contact switch of the present invention.

Referring to FIG. 1, which is a separation illustration, the present invention is comprised of a connection seat major body 1, a contact switch 2, and several fixing guide-needles 18. Wherein, an inserting groove 12 is arranged on the back face of the connection seat major body 1 and several grooves 16 are also arranged on the upper portion of the inserting groove 12 as seen in FIGS. 3A–3C. The major characteristic of the present invention is contact switch 2 in an electric wire connection seat. Thus when an electric wire connection head 3 is inserting into the inserting groove, as shown in dashed lines in FIG. 2, the contact arms 21 of the contact switch 2 will be pressed down by the electric wire connection head portion 31 and separate from the contact-press-connection points 22 and change the state of the electric circuit. We can apply this phenomenon to control on or off of an electric circuit to show different states of the electric circuit. The connection seat major body 1 is made by plastic-injection molding. The guide-needles 18 are made by pressing or other methods. The contact switch 2 (as shown in FIG. 4) is comprised of a block 23, contact arms 21 and contact press points 22. Wherein, contact arms and contact points 21, 22 are made by pressing or other methods and vertically penetrate through the block 23 in parallel with each other. A convex block 24, arranged on the upper portion of the block 23, fastens with opening 17 in the connection seat major body 1 to achieve the function of fixing these elements together. Ends 211, 221 of control arm 21, and contact points 22 are sharpened, and extend out of the block 23, while opposite ends have flat plate pieces 212, 222. The flat plate pieces are contacted with each other. The middle sections 213 of the contact arms 21 are raised up, which will be pressed down as the electric wire connection head 3 is inserted into major body 1 and to achieve the function of turning off the circuit.

Therefore, the contact switch 2, inserted in the connection seat major body 1 of the present invention, is made by the plastic-injection molding and fixed with the connection seat major body 1 by the convex block 24. Please refer to FIG. 2, which is a separation illustration for the present invention. The invention of electric wire connection head 3 into the inserting grooves 12 of the connection seat major body 1, causes the contact arms 21 to be pressed down (as illustrated in dashed lines in FIG. 2) to cause a break in the electric circuit. In this way, we do not need another device to show the connection situation of an electric circuit. The design, the manufacture and the assembly are quick and convenient and possess the merits of decreased cost and increased quality.

The above descriptions are the preferable embodiments of the present invention. The covered scopes of the present invention are not restricted on the embodiments shown. All the changes according to the contents of the present invention, such as: the change of shapes or locations of the arrangement of the fastening structures, etc., the generated functions and characteristics similar to those of the embodiments of the present invention and any ideas thought by the persons well-known such technologies are all within the scopes of the present invention.

What is claimed is:

1. An electric wire connection seat assembly comprising:

a) a connection seat major body having: an inserting groove configured to receive a connection head therein, the inserting groove opening through a rear side of the connection seat major body; a plurality of guide-needles extending outwardly from a front side thereof; and an opening in the front side of the connection seat major body; and, b) a contact switch including: a block located in the opening in the front side of the connection seat major body and attached to the connection seat major body; a pair of contact points extending through the block, each contact point having a first end extending outwardly from the block, and a second end having a first flat plate and located interiorly of the connection seat major body; and a pair of contact arms extending through the block, each contact arm having a first end extending exteriorly of the block, an upwardly displaced middle portion located interiorly of the connection seat major body, and a second end having a second flat plate in contact with the first flat plate of one of the pair of contact points, wherein the middle portion are located so as to be contacted by a connection head inserted into the inserting groove so as to displace the contact arms thereby moving the second flat plates out of contact with the first flat plates.

2. The electric wire connection seat assembly of claim 1 further comprising a convex block extending from the block to attach the block to the connection seat major body.

3. The electric wire connection seat assembly of claim 1 wherein the middle portions of the pair of contact arms are curved.

* * * * *